US005358249A

United States Patent [19]

Mendralla

[11] Patent Number: 5,358,249

[45] Date of Patent: Oct. 25, 1994

[54] GOLF CLUB WITH PLURALITY OF INSERTS

[75] Inventor: Robert A. Mendralla, Bloomingdale, Ill.

[73] Assignee: Wilson Sporting Goods Co., Chicago, Ill.

[21] Appl. No.: 85,727

[22] Filed: Jul. 6, 1993

[51] Int. Cl.[5] ..... A63B 53/04

[52] U.S. Cl. ..... 273/173; 273/167 R; 273/167 J

[58] Field of Search ..... 273/167 R, 167 J, 173, 273/78

[56] References Cited

U.S. PATENT DOCUMENTS

| | | | |
|---|---|---|---|
| 3,937,474 | 2/1976 | Jepson et al. | 273/173 |
| 3,975,023 | 8/1976 | Inamori . | |
| 4,181,306 | 1/1980 | Jepson . | |
| 4,573,685 | 3/1986 | Young, IV et al. . | |
| 4,582,321 | 4/1986 | Yoneyama . | |
| 4,679,792 | 7/1987 | Straza et al. . | |
| 4,681,322 | 7/1987 | Straza et al. . | |
| 4,768,787 | 9/1988 | Shira . | |
| 4,792,140 | 12/1988 | Yamaguchi et al. . | |
| 4,798,383 | 1/1989 | Nagasaki et al. . | |
| 4,801,146 | 1/1989 | Honma . | |
| 4,809,978 | 3/1989 | Yamaguchi et al. . | |
| 4,884,812 | 12/1989 | Nagasaki et al. . | |
| 4,934,703 | 6/1990 | Delaney | 273/167 R X |
| 5,016,883 | 5/1991 | Kobayashi . | |
| 5,024,437 | 6/1991 | Anderson . | |
| 5,078,397 | 1/1992 | Aizawa . | |
| 5,100,144 | 3/1992 | Okumoto et al. | 273/167 J |

*Primary Examiner*—Vincent Millin
*Assistant Examiner*—Raleigh W. Chiu

[57] ABSTRACT

A golf club head includes a plurality of elongated strips of insert material in the face of the club head. The face is provided with a plurality of recesses, and the insert material fills the recesses. The face may also be provided with an elongated groove between each pair of adjacent recesses.

23 Claims, 3 Drawing Sheets

GOLF CLUB WITH PLURALITY OF INSERTS

BACKGROUND

This invention relates to golf clubs, and, more particularly, to a golf club head which is provided with a plurality of elongated, spaced-apart inserts.

The rules of golf have recently been modified to permit a golf club head, in particular an iron-type club head, to include an insert in the face of the club. The material of the insert may be different than the material of the club face. As a result, many club heads have been designed which include an insert in the face.

The inserts which have heretofore been designed conventionally are monolithic pieces which provide a continuous hitting surface on the face of the club head. The insert may extend over substantially the entire portion of the face which normally contacts the golf ball, or it may occupy a smaller portion of the face in the sweet spot of the club head.

SUMMARY OF THE INVENTION

A club head formed in accordance with the invention includes a plurality of elongated, spaced-apart inserts in the face of the club head. The material of face is exposed in the areas between the inserts, and the hitting surface which contacts the golf ball at impact comprises alternating areas of insert material and face material. It is believed that such a face construction provides improved feel at the time of ball impact compared with a face on which only a single material contacts the ball.

DESCRIPTION OF THE DRAWING

The invention will be explained in conjunction with illustrative embodiments shown in the accompanying drawing, in which.

DESCRIPTION OF SPECIFIC EMBODIMENTS

Figure 1:
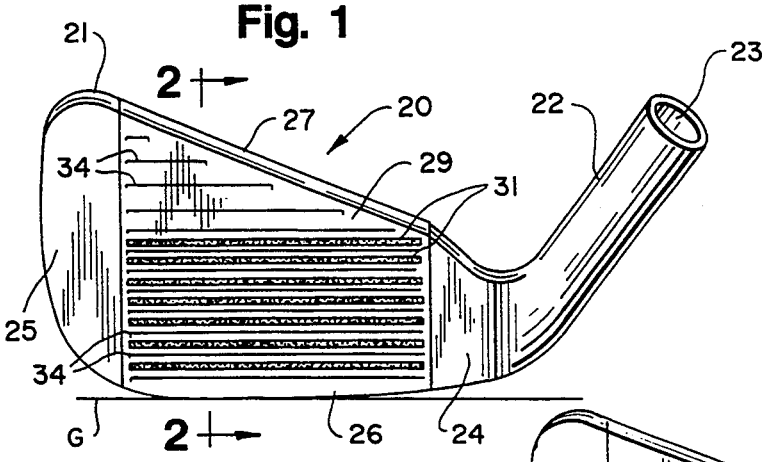
FIG. 1 is a front elevational view of an iron-type club head formed in accordance with the invention.
Figure 2:
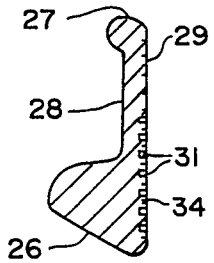
FIG. 2 is a sectional view taken along the line 2—2 of FIG. 1.
Figure 2A:
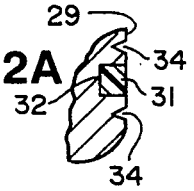
FIG. 2A is an enlarged view of a portion of FIG. 2.

Referring first to FIGS. 1, 2, and 2A, the numeral 20 designates generally an iron-type of club head which includes a body or blade 21 and a hosel 22. The hosel is provided with a bore 23 for attaching the club head to a conventional shaft.

The blade includes a heel 24 which joins with the hosel, a toe 25, a sole 26, a top edge or surface 27, a back surface 28, and a ball-striking face 29. The angle of the plane of the face relative to the centerline or axis of the hosel defines the loft angle of the club head, and the loft angle is designated by the number of the club head. Iron club heads are conventionally numbered from 1 through 9 and pitching wedge.

The face 29 is flat, and a plurality of elongated, spaced-apart inserts 31 are embedded in the face. The outer surface of each insert is preferably flush with the flat surface of the face. The club head is provided with a recess 32 for each insert, and the insert fills the recess. The recesses and the inserts extend between the heel 24 and the toe 25. In the preferred embodiment the recesses and inserts are parallel and extend parallel to the ground plane G which the center of the sole of the club head contacts when the club head is in the proper lie angle.

The face 29 is also provided with a plurality of conventional grooves 34. In the embodiment illustrated in FIG. 1, a groove extends between each pair of adjacent inserts 31, and additional grooves are located in the upper portion of the face above the uppermost insert. If desired, inserts could also be located in the upper portion of the face. However, since the upper portion of the face rarely contacts the golf ball, inserts need not be located there.

The grooves 34 advantageously extend parallel to the inserts 31 and to the ground plane G. The grooves also extend for the same or substantially the same length as the inserts, although the grooves can also be shorter or longer than the inserts.

The grooves 34 are conventional and in accordance with U.S.G.A. Rules. The width and depth of the grooves can be up to 0.035 inch and 0.020 inch, respectively, and the minimum land width between grooves is 0.075 inch. The width and depth of the recesses 32 and inserts 31 are substantially greater. The width of the recesses can be within the range of about 0.062 to about 0.312 inch. The depth of the recesses can be about 0.062 to about 0.250 inch.

The iron-type club head can be formed by conventional forging or casting techniques. Both the recesses 32 and the grooves 34 are formed in the face during the forging or casting operation. After the club head is polished or buffered, the inserts 31 are positioned in the recesses.

The material of the inserts 31 is different than the material of the face 29. The inserts can be either harder or softer than the material of the face. In most cases the material of the insert will be softer than the material of the face. The insert will thereby cushion and absorb the impact with the ball.

In specific embodiments of the invention the inserts have been formed from urethane, epoxy, and composite material consisting of graphite fibers and epoxy resin. The iron clubheads were formed from stainless steel. Other metals or alloys can also be used, for example, beryllium copper. Specific urethane and epoxy which have been used are polyurethane with a durometer hardness of 90 and Hardman Epoweld epoxy. The recesses 32 can be filled with liquid urethane or epoxy which thereafter cures or hardens.

The width and spacing of the inserts are preferably selected so that a golf ball will always contact both the material of the insert and the material of the face during impact. A golf ball compresses and flattens when it is struck by a golf club, and the diameter of the flattened portion of a golf ball ranges from about 12/16 to 15/16 inch for a 9 iron to about 15/16 to 1-1/16 inch for a driver with a club head speed of 160 feet per second. The size of the flattened portion of the ball varies depending upon the compression rating of the ball, the material of the ball, and the speed of the club head.

The width and spacing of the inserts can also be selected so that the ball contacts at least two or more inserts or at least two or more face portions during impact.

In the embodiment illustrated in FIG. 1 there are seven inserts 31 and twelve grooves 34. More or less inserts and grooves can be used as desired. The width of the inserts is 0.062 inch, and the width of the face portions between adjacent insert is 0.082 inch. The lengths of the inserts and the grooves are the same.

Figure 3:
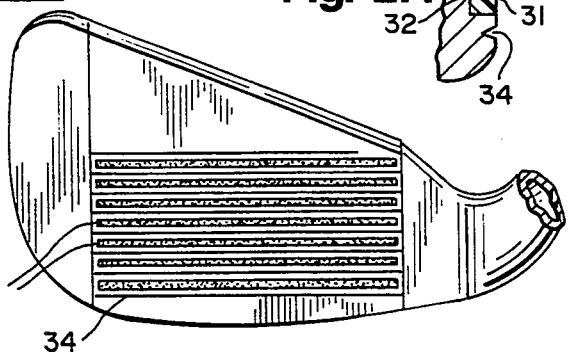
FIGS. 3 through 6 are elevational views of modified embodiments of an iron club head.

In FIG. 3 the grooves 34 are slightly longer than the inserts 31. The width and spacing of the inserts are the same as in FIG. 1.

Figure 4:
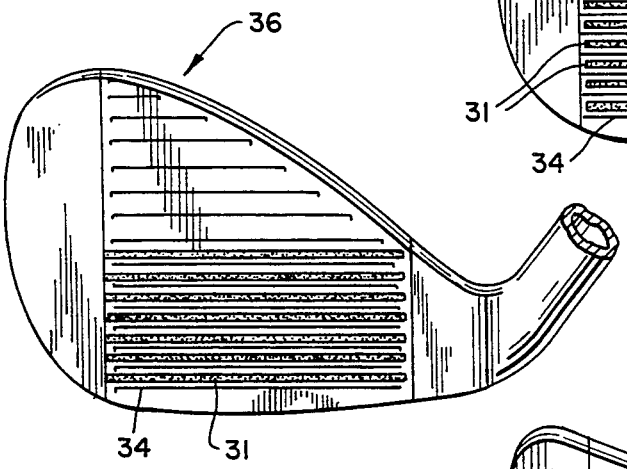

FIG. 4 illustrates a more lofted club 36 than the club of FIG. 1. The width and spacing of the inserts are the same as in FIG. 1, but the inserts are slightly longer than the grooves. There are seven inserts and fifteen grooves, but more or less inserts and grooves can be used.

Figure 5:
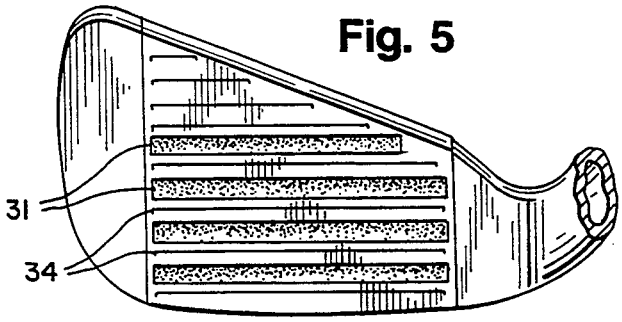

In FIG. 5 the width and spacing of the inserts 31 are greater than in FIG. 1. The width of the inserts is about 0.125 inch, and the spacing between inserts is about 0.156 inch. There are four inserts and eight grooves.

Figure 6:
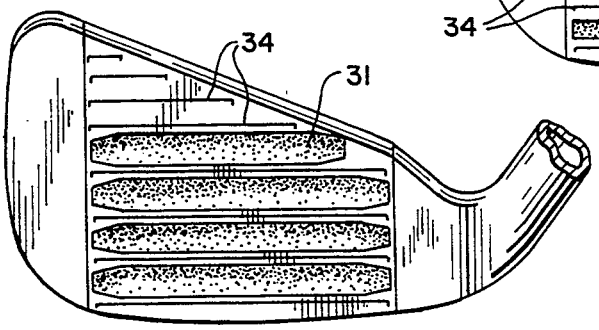

In FIG. 6 the width of the inserts is about 0.218 inch, and the spacing between inserts is about 0.093 inch. There are four inserts and eight grooves. Again, more or less inserts and groove can be used.

Figure 7:
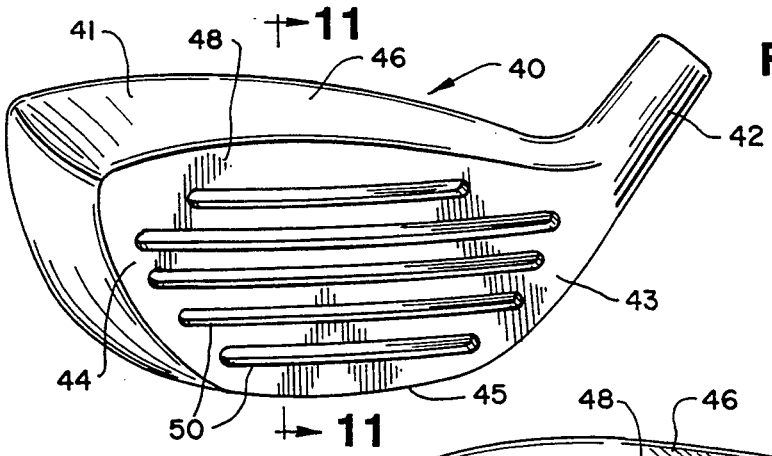
FIG. 7 is an elevational view of a wood-type club head.
Figure 8:
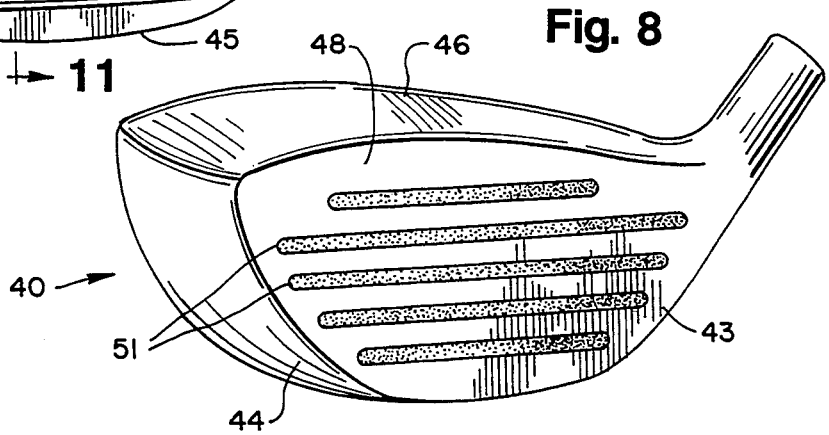
FIGS. 8 through 10 are elevational views of modified embodiments of wood-type club heads.

FIGS. 7 and 8 illustrate a wood-type club head 40 which is made in accordance with the invention. Wood-type club heads were historically made from wood, but many wood-type club heads are now made from metal or composite material. The invention can be used with wood-type club heads made from either wood, metal, or other materials.

The club head 40 includes a body 41 and a hosel 42. The body includes a heel 43, a toe 44, a sole 45, a top surface 46, a back surface 47 (FIG. 11), and a face 48. The face of wood-type clubs are conventionally provided with bulge and roll curvatures and are not flat or planar.

A plurality of elongated, spaced-apart, parallel recesses 50 (FIG. 7) are provided in the face 48, and each recess is filled with an insert 51 (FIG. 8). The recesses and inserts extend between the heel 43 and the toe 44 generally parallel to the ground plane which the sole engages when the club head is in the proper lie angle.

The material of the inserts for the wood-type club heads can also be either harder or softer than the material of the face. The inserts are preferably softer than the face, and specific insert materials which can be used are urethane and epoxy.

The speed of a wood-type club head is generally faster at impact than the speed of an iron, and the flattened area of the ball at impact will be greater. The width and/or spacing of the inserts can therefore be greater in a wood than in an iron.

In FIGS. 7 and 8 there are five recesses and inserts. The width of the inserts is about 0.110 inch, and the spacing between inserts is about 0.125 inch. The particular embodiment illustrated in FIGS. 7 and 8 does not have grooves on the face, but grooves can be provided between the inserts if desired.

The club head 40 of FIGS. 7 and 8 is made from stainless steel, but other metals can be used. The club head can also be made from wood, or composite material.

Figure 11:
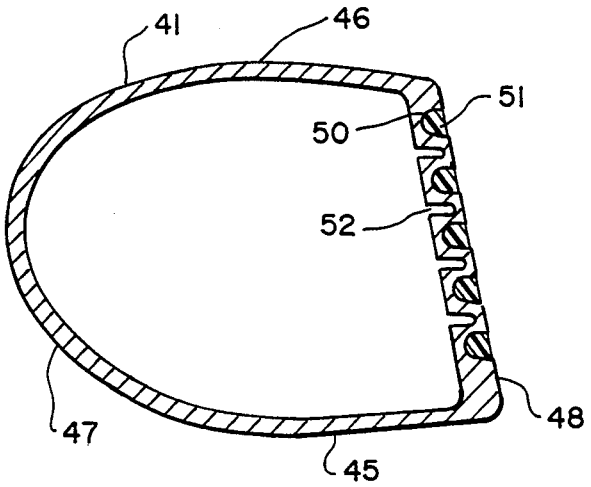
FIG. 11 is a sectional view taken along the line 11—11 of FIG. 7.

Referring to FIG. 11, the body 41 of the club head 40 is hollow and is conventionally formed by investment casting. The recesses 50 are formed during the casting process. A plurality of inner grooves or recesses 52 are formed on the inside surface of the face to reduce the weight of the club head.

The recesses 50 and inserts 51 in FIG. 11 are generally U-shaped and have rounded bottoms. The width of the recesses is about 0.125 inch and the depth of the recesses is about 0.125 inch. The spacing between adjacent recesses is 0.125 inch.

Figure 12:
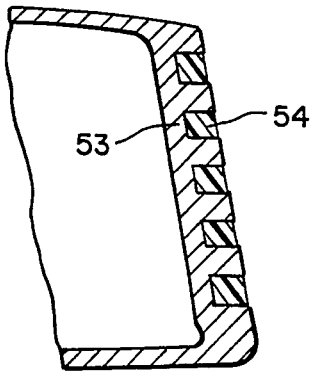
FIGS. 12 through 15 are fragmentary sectional views of modified wood-type club heads.

FIG. 12 illustrates a modified embodiment in which the recesses 53 and inserts 54 are rectangular in cross section. The width and spacing of the recesses is the same as in FIG. 11. The depth of the recesses is about 0.150 inch.

Figure 9:
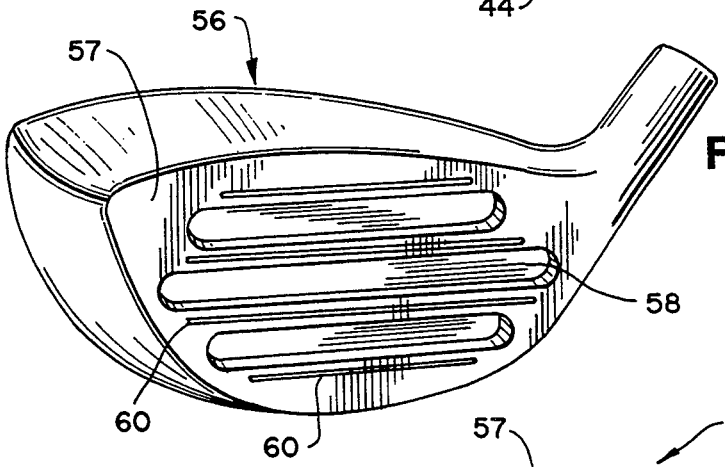
Figure 10:
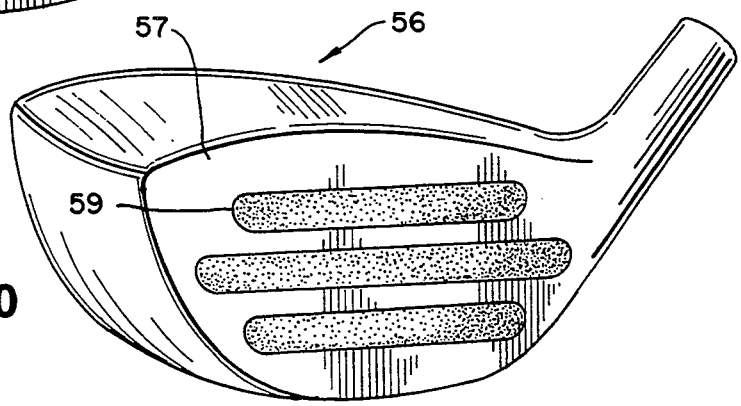

FIGS. 9 and 10 illustrate a club head 56 with a face 57 which has three recesses 58 (FIG. 9) and inserts 59 (FIG. 10). The width of the recesses is about 0.250 inch, and the spacing between the inserts is about 0.135 inch. Conventional face grooves 60 are positioned between the inserts and above and below the inserts. The grooves extend parallel to the inserts.

Figure 13:
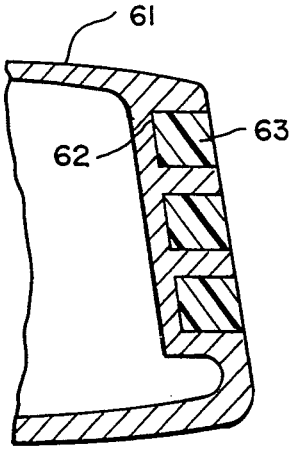
Figure 14:
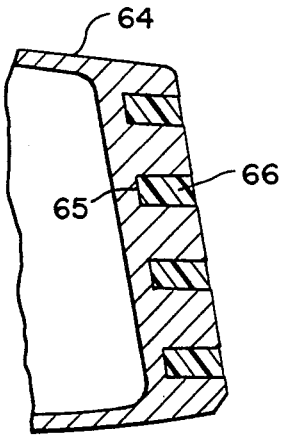
Figure 15:
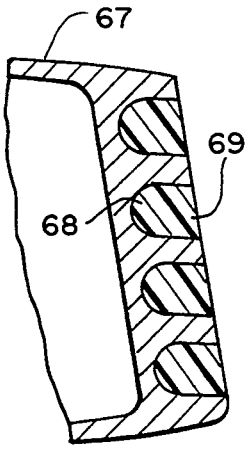

FIGS. 13–15 are fragmentary sectional views of other embodiments of wood-type club heads with different sizes and shapes of recesses and inserts. The club head 61 in FIG. 13 includes three large rectangular recesses 62 and inserts 63. The recesses are about 0.250 inch wide and about 0.250 inch deep, and the spacing is about 0.125 inch.

The club head 64 in FIG. 14 includes four thinner rectangular recesses 65 and inserts 66 which are spaced farther apart. The club head 67 in FIG. 15 includes four U-shaped recesses 68 and inserts 69.

The dimensions which are described herein are subject to the normal manufacturing tolerances of forged and cast golf club heads.

While in the foregoing specification a detailed description of specific embodiments of the invention was set forth for the purpose of illustration, it will be understood that many of the details herein given may be varied considerably by those skilled in the art without departing from the spirit and scope of the invention.

I claim:

1. A golf club head comprising a body having a sole, a toe portion, a heel portion, a top surface, a back surface, and a ball-striking face, the face being formed of a first material and having a plurality of elongated spaced-apart recesses therein, the recesses being filled with an insert material which is different than the first material and which is substantially flush with the ball-striking face.

2. A golf club head comprising a body having a sole, a toe portion, a heel portion, a top surface, a back surface, and a ball-striking face, the face being formed of a first material and having a plurality of elongated spaced-apart recesses therein, the recesses being filled with an insert material which is different than the first material, the material of the face being metal and the insert material being softer than the metal of the face.

3. The club head of claim 2 in which the insert material is urethane.

4. The club head of claim 2 in which the insert material is epoxy.

5. The club head of claim 1 in which the insert material is graphite fibers and resin.

6. The club head of claim 1 in which the recesses are parallel and extend between the toe portion and the heel portion.

7. A golf club head comprising a body having a sole, a toe portion, a heel portion, a top surface, a back surface, and a ball-striking face, the face being formed of a first material and having a plurality of elongated spaced-apart recesses therein, the recesses being filled with an insert material which is different than the first material, the recesses being parallel and extending between the toe portion and the heel portion, the face being provided with an elongated groove between each pair of adjacent recesses, the grooves extending parallel to the recesses.

8. A golf club head comprising a body having a sole, a toe portion, a heel portion, a top surface, a back surface, and a ball-striking face, the face being formed of a first material and having a plurality of elongated spaced-apart recesses therein, the recesses being filled with an insert material which is different than the first material, the face being provided with an elongated groove between each pair of adjacent recesses.

9. The club head of claim 8 in which the grooves and the recesses are substantially the same length.

10. The club head of claim 1 in which the club head is an iron-type of club head.

11. The club head of claim 1 in which the club head is a wood-type of club head.

12. The club head of claim 1 in which the width of the recesses is within the range of about 0.062 to about 0.312 inch.

13. A golf club head comprising a body having a sole, a toe portion, a heel portion, a top surface, a back surface, and a ball-striking face, the face being formed of a first material and having a plurality of elongated spaced-apart recesses therein, the recesses being filled with an insert material which is different than the first material, the width of the recesses being within the range of about 0.062 to about 0.312 inch, the face being provided with an elongated groove between each pair of adjacent recesses.

14. The club head of claim 1 in which the face has at least three of said recesses.

15. A golf club head comprising a body having a sole, a toe portion, a heel portion, a top surface, a back surface, and a ball-striking face, the face being formed of metal and having at least three elongated, parallel, spaced-apart recesses therein which are filled with insert material which is softer than the metal of the face, the face having an elongated groove between each pair of adjacent recesses which extends parallel to the recesses.

16. The club head of claim 15 in which the insert material is urethane.

17. The club head of claim 15 in which the insert material is epoxy.

18. The club head of claim 15 in which the recesses and the grooves extend between the toe portion and the heel portion.

19. The club head of claim 15 in which the grooves and the recesses are substantially the same length.

20. The club head of claim 15 in which the club head is an iron-type of club head.

21. The club head of claim 15 in which the club head is a wood-type of club head.

22. The club head of claim 15 in which the width of the recesses is within the range of about 0.062 to about 0.312 inch.

23. The club head of claim 15 in which the face is provided with an elongated groove between each pair of adjacent recesses.

* * * * *